US005279677A

United States Patent [19]

Das

[11] Patent Number: 5,279,677

[45] Date of Patent: Jan. 18, 1994

[54] RINSE AID FOR METAL SURFACES

[75] Inventor: Narayan Das, Libertyville, Ill.

[73] Assignee: Coral International, Inc., Waukegan, Ill.

[21] Appl. No.: 716,311

[22] Filed: Jun. 17, 1991

[51] Int. Cl.[5] ..... C23G 1/02

[52] U.S. Cl. ..... 134/3; 252/557

[58] Field of Search ..... 252/549, 557; 134/3

[56] References Cited

U.S. PATENT DOCUMENTS

| | | | |
|---|---|---|---|
| Re. 27,662 | 6/1973 | Hamilton | 252/49.8 |
| Re. 32,661 | 5/1988 | Binns | 252/79.3 |
| 1,970,578 | 8/1934 | Schoeller et al. | 252/555 |
| 2,285,853 | 6/1942 | Downing et al. | 252/49.3 |
| 2,978,026 | 4/1961 | Bemis | 252/555 |
| 3,239,467 | 3/1966 | Lipinski | 252/144 |
| 3,492,232 | 1/1970 | Rosenberg | 252/559 |
| 3,526,596 | 9/1970 | Kress et al. | 252/557 |
| 3,718,588 | 2/1973 | Bellos et al. | 252/549 |

(List continued on next page.)

FOREIGN PATENT DOCUMENTS

| | | | |
|---|---|---|---|
| 0137057 | 4/1985 | European Pat. Off. . | |
| 2313330 | 3/1973 | Fed. Rep. of Germany . | |
| 214934 | 1/1973 | France . | |
| 716354 | 10/1954 | United Kingdom . | |
| 2130237 | 5/1984 | United Kingdom | 252/549 |
| 2187206 | 9/1987 | United Kingdom . | |

OTHER PUBLICATIONS

"Coatings For Glass Containers", Sanyal and Mukerji, The Glass Industry, Nov. 1982.

"GAF Chemicals", Inc., Greenville, S.C., 1984, pp. 11-19.

"Ethox Chemicals, Inc.", Greenville, S.C., 1984, pp. 3-6, 9-13.

"Product Data, Chemax, Inc., Chemal LFL-47-C", Mar. 1989.

"Technical Data on Typical Properties of Pluronic® Polyols", BASF Wyandotte Corp., Wyandotte, Mi., not dated.

"The Pluronic® Grid, Eighth Edition", BASF Wyandotte Corp., Wyandotte, Mi, not dated.

"Pluronic® & Tetronic® Surfactants", BASF Corporation, 1987, pp. 18-19.

"NEODOL® Ethoxylates and Competitive Nonionics, Properties Guide", Shell Chemical Company, 1982, pp. 42-49.

"NEODOL, Properties, Processing & Applications of NEODOL" Alcohols, Ethoxylates & Ethoxysulfates, Shell Chemical Company, not dated, pp. 4-7.

"NEODOL, Product Guide for Alcohols, Ethoxylates & Ethoxysulfates", Shell Chemical Company, May 1990, pp. 4-8.

"The Parker Company Process Specification No. 148, PARCOLENE® 30 Chemical", May 12, 1971.

"Training Program II-G, Parcolene 1, 2, 3, 6, 8, 10, 24, 30, 60, 62, W, Z", The Parker Chemical Co., Jan. 31, 1966.

"Corak 71—Operating Bulletin".

"Rinse Aid"—Operating Bulletin.

*Primary Examiner*—Gary P. Straub

*Assistant Examiner*—Stuart L. Hendrickson

*Attorney, Agent, or Firm*—Fitch, Even, Tabin & Flannery

[57] ABSTRACT

An aqueous composition for treating metal surfaces, particularly formed aluminum and aluminum alloy surfaces, comprising a surface tension reducing agent selected from the group consisting of sulfosuccinate salts and derivatives and mixtures thereof, a surfactant selected from the group consisting of propoxylated and ethoxylated linear alcohols, and an acid such as phosphoric acid, as well as preferably a bactericide and a defoamant, and a method for treating metal surfaces, particularly beverage containers, such as of aluminum and aluminum alloy with such a composition.

29 Claims, 4 Drawing Sheets

U.S. PATENT DOCUMENTS

| | | | |
|---|---|---|---|
| 3,826,675 | 7/1974 | Smith et al. | 252/49.8 |
| 3,832,962 | 9/1974 | Rolles | 252/443 |
| 3,836,494 | 9/1974 | Hekal et al. | 252/549 |
| 3,852,210 | 12/1974 | Krezanoski | 252/95 |
| 3,857,865 | 12/1974 | Sturwold et al. | 252/49.5 |
| 3,860,521 | 1/1975 | Aepli et al. | 252/49.3 |
| 3,893,931 | 7/1975 | Sturwold et al. | 252/49.5 |
| 3,904,569 | 9/1975 | Hekal et al. | 252/49.3 |
| 3,912,642 | 10/1975 | Sturwold et al. | 252/49.5 |
| 3,923,471 | 12/1975 | Smith et al. | 204/56 |
| 3,945,930 | 3/1976 | Sugiyama et al. | 252/49.5 |
| 3,964,936 | 6/1976 | Das | 148/26 |
| 3,968,311 | 7/1976 | Hekal et al. | 428/461 |
| 3,969,135 | 7/1976 | King et al. | 134/40 |
| 4,054,466 | 10/1977 | King et al. | 106/14 |
| 4,108,099 | 8/1978 | Fidler et al. | 427/358 |
| 4,116,872 | 9/1978 | Jahnke | 252/32.5 |
| 4,148,670 | 4/1979 | Kelly | 148/6.27 |
| 4,177,154 | 12/1979 | Chakrabarti | 252/49.3 |
| 4,191,801 | 3/1980 | Jahnke | 252/396 |
| 4,212,750 | 7/1980 | Gorman | 252/49.5 |
| 4,215,002 | 7/1980 | Fein | 252/49.3 |
| 4,260,499 | 4/1981 | Fein et al. | 252/32.5 |
| 4,260,502 | 4/1981 | Slanker | 252/49.5 |
| 4,265,774 | 5/1981 | Langdon | 252/49.3 |
| 4,273,592 | 6/1981 | Kelly | 148/6.27 |
| 4,366,077 | 12/1982 | Andrew et al. | 252/49.3 |
| 4,370,177 | 1/1983 | Frelin et al. | 148/6.27 |
| 4,371,476 | 2/1983 | Newkirk et al. | 252/11 |
| 4,382,825 | 5/1983 | McCready | 252/135 |
| 4,384,965 | 5/1983 | Hellsten et al. | 252/49.3 |
| 4,422,886 | 12/1983 | Das et al. | 252/6.27 |
| 4,435,223 | 3/1984 | Dollman | 134/3 |
| 4,452,712 | 6/1984 | Laemmle | 252/49.3 |
| 4,457,322 | 7/1984 | Rubin et al. | 134/2 |
| 4,461,712 | 7/1984 | Jonnes | 252/49.3 |
| 4,470,853 | 9/1984 | Das et al. | 148/6.27 |
| 4,477,290 | 10/1984 | Carroll et al. | 134/2 |
| 4,506,533 | 3/1985 | Hessel et al. | 72/42 |
| 4,507,339 | 3/1985 | Carbo et al. | 428/35 |
| 4,518,512 | 5/1985 | Kanamori | 252/49.5 |
| 4,521,321 | 6/1985 | Anderson et al. | 252/49.3 |
| 4,599,116 | 7/1986 | King et al. | 134/3 |
| 4,601,838 | 7/1986 | Kammann, Jr. et al. | 252/49.3 |
| 4,604,220 | 8/1986 | Stanton | 252/49.3 |
| 4,612,128 | 9/1986 | Uematsu et al. | 252/49.8 |
| 4,637,117 | 1/1987 | Karas et al. | 72/347 |
| 4,637,885 | 1/1987 | Kuwamoto et al. | 252/49.8 |
| 4,650,595 | 3/1987 | Nagamori et al. | 252/49.3 |
| 4,657,685 | 4/1987 | Uematsu et al. | 252/49.8 |
| 4,710,409 | 12/1987 | Lahaye et al. | 427/421 |
| 4,731,190 | 3/1988 | O'Lenick, Jr. et al. | 252/49.3 |
| 4,752,405 | 6/1988 | Kyle et al. | 252/49.5 |
| 4,758,359 | 7/1988 | Kirk et al. | 252/49.3 |
| 4,857,225 | 8/1989 | Terada et al. | 252/100 |
| 4,859,351 | 8/1989 | Award | 252/32.5 |
| 4,889,654 | 12/1989 | Mason et al. | 252/100 |
| 4,944,889 | 7/1990 | Awad | 252/32 |
| 4,950,415 | 8/1990 | Malito | 252/49.3 |
| 4,980,076 | 12/1990 | Tanaka et al. | 252/79.4 |
| 5,014,536 | 5/1991 | Saunders | 72/349 |
| 5,030,323 | 7/1991 | Awad | 252/79.3 |
| 5,064,500 | 11/1991 | Awad | 134/3 |
| 5,080,814 | 1/1992 | Awad | 252/49.3 |
| 5,132,037 | 7/1992 | Greene et al. | 252/557 |

RINSE AID FOR METAL SURFACES

INTRODUCTION

Technical Field

This invention relates to a chemical composition and method useful for improving certain properties of metal surfaces, particularly aluminum and aluminum alloy surfaces. More particularly, this invention relates to the chemical treatment of aluminum surfaces to reduce the amount of water remaining on the surfaces after washing and rinsing so that the aluminum surfaces, in particular aluminum can surfaces, can be dried more quickly at a much reduced oven temperature.

BACKGROUND

Aluminum cans are commonly used as containers for a wide variety of products, notably food and beverages. After manufacture, aluminum cans are washed, typically with an acidic cleaner, to remove aluminum fines and other residues. The cans are then rinsed with tap water, followed by deionized water, and dried in a hot air oven.

The rinsing of the aluminum cans in the cleaning treatment cycle results in the retention of a large amount of water on the surfaces of the cans. The retained water necessitates long oven drying time and high temperature to obtain efficient drying of the cans. Not only does this result in increased production time and cost, but water droplet formation increases the likelihood of water spot formation. Water spots decrease adhesion to subsequently applied overcoatings and finishes, such as decorative inks and overvarnishes.

Therefore, a chemical composition and method are highly desirable which provide water-break-free surface properties to aluminum and aluminum alloy surfaces and minimize the amount of water on such surfaces after being cleaned and rinsed, without adversely affecting adhesion properties. It would be ideal if the use of such a chemical composition could be incorporated into the treatment cycle, without necessitating changes to existing can manufacturing facilities.

The treatment should preferably provide the surface of an aluminum container, in particular aluminum beverage containers, with a clear, colorless, thin coating that retains the brightness of the aluminum surface, yet will not affect the taste of the food or beverage to be contained therein. More preferably, the treatment should reduce the surface tension, and thereby the amount, of water remaining on aluminum surfaces after washing and rinsing. Additionally, the treatment should provide the surface of the aluminum container with water-break-free surface characteristics so that water droplets do not form, thereby avoiding water spots. In the prevention of water spots, the treatment should not adversely affect, and preferably should optimize, adhesion to subsequently applied overcoatings and finishes. Moreover, the treatment should preferably decrease the time and temperature required to dry the aluminum surfaces, thereby reducing production time and cost.

These benefits are realized through use of the present inventive composition and method, which provide aluminum and aluminum alloy surfaces with water-break-free surface characteristics and reduce the quantity of water remaining on such surfaces after cleaning and rinsing. Water-break-free surface characteristics aid in the prevention of the formation of water droplets and, subsequently, water spots. Consequently, adhesion to subsequently applied overcoatings and finishes is optimized. Furthermore, the time and temperature required to dry the aluminum surfaces are decreased, thereby reducing production time and cost.

RELEVANT LITERATURE

The prior literature is replete with references to various compositions which provide metal surfaces, such as aluminum, with desirable surface characteristics.

U.S. Pat. No. 4,859,351 discloses a composition which functions as a lubricant and surface conditioner for formed metal surfaces, particularly aluminum beverage cans. The composition purportedly reduces the coefficient of static friction of the metal surfaces and increases their mobility. The conditioner may be used at any time during processing but is preferably used as a final rinse in an aluminum can washer to obtain a thin organic film on the surfaces of aluminum cans to enhance their mobility during subsequent processing. The adhesion of paints or lacquers to the treated surfaces is reported to be unaffected. The composition consists essentially of a water-soluble, organic material selected from the group of phosphate esters, alcohols, fatty acids, including mono-, di-, tri- and poly-acids, fatty acid derivatives, such as salts, hydroxy acids, amides, esters, ethers, and derivatives thereof, and mixtures thereof. Ethoxylated stearic acids and ethoxylated alkyl alcohol phosphate esters, used in an aqueous solution at a pH of about 1.0–6.5, are identified as preferred compounds.

U.S. Pat. No. 4,435,223 discloses a composition and method for cleaning aluminum surfaces, wherein the composition contains sulfuric acid, phosphoric acid, and at least one surfactant. A combination of a high detergency surfactant and a low foaming surfactant is preferably used in the composition. An ethoxylated abietic acid derivative may be used as the high detergency surfactant, whereas an alkyl polyethoxylated ether may be used as the low foaming surfactant. The composition is sprayed onto the aluminum surface, particularly aluminum beverage cans, to effect cleaning to a water-break-free condition such that the aluminum surface can be subjected to further processing, e.g., the application of lacquer and inks.

U.S. Pat. No. 3,239,467 discloses a composition for cleaning and treating metal surfaces, such as aluminum, stainless steel, and titanium, which purportedly improves the ability of the surfaces to bond to organic coatings and adhesives. The composition consists essentially of glycol ether and triglycol dichloride and may also contain an acid such as nitrosulfonic acid in water to provide the composition with a pH of about 0.5–3.0.

U.S. Pat. No. 4,980,076 discloses an acid rinse composition and process which is used for suitably etching and rinsing aluminum and aluminum alloy surfaces. The composition contains water, orthophosphoric acid, an aluminum ion sequestrant, and ferric ion and may also contain surfactant and dissolved aluminum ions. The aluminum ion sequestrant is selected from among sulfuric acid, organic acids, boric acid, condensed phosphoric acids, organophosphonic acids, and phosphorous acid. The ferric ion may be added as ferric sulfate or ferric nitrate, and preferably the composition contains $H_2O_2$, $NO_2^{-1}$ ions, or a mixture thereof to reoxidize ferrous ions formed by the reduction of ferric ions during use of the composition. The pH of the rinse composition is preferably 0.6–2.0. Surfactants, such as alkyl ethers, abietic acid derivatives, and alkyldimethylamine oxides, may be used for the purpose of improving the rinsing effectiveness in removing oil adhered to the aluminum surface or by reducing the surface tension of the rinse solution.

The above compositions, in contrast to the composition of the present invention, do not purport to reduce the amount of water remaining on aluminum surfaces after washing and rinsing so that the aluminum surfaces, in particular aluminum can surfaces, can be dried more quickly at a much reduced oven temperature while optimizing adhesion to subsequently applied overcoatings and finishes and not adversely affecting the flavor characteristics of beverages and other food products in contact with the treated aluminum surfaces.

BRIEF SUMMARY OF THE INVENTION

The present invention concerns a composition for application to formed metal surfaces, particularly aluminum and aluminum alloy surfaces, and a method of treating metal surfaces with such a composition.

An object of the present invention is to reduce the surface tension and amount of water remaining on aluminum and aluminum alloy surfaces after washing and rinsing and to decrease the time and temperature necessary to dry aluminum and aluminum alloy surfaces.

An additional object of the present invention is to provide aluminum and aluminum alloy surfaces with water-break-free surface characteristics after washing and rinsing and to reduce or prevent the formation of water spots on aluminum and aluminum alloy surfaces after drying.

A further object of the present invention is to optimize adhesion of aluminum and aluminum alloy surfaces to subsequently applied overcoatings and finishes.

Yet another object of the present invention is to treat the aluminum surfaces without adversely affecting the flavor characteristics of beverages and other food products in contact with the treated aluminum surfaces.

These and other objects and advantages of this invention, as well as additional inventive features, will become apparent from the description which follows.

The present invention provides a composition for treating aluminum and aluminum alloy surfaces, and a method for treating such surfaces, which decrease the surface tension and amount of water remaining on such surfaces after washing and rinsing so as to decrease the time and temperature of drying those surfaces, provide those surfaces with water-break-free characteristics and reduce or prevent the formation of water spots upon drying of the surfaces, and optimize adhesion of the aluminum and aluminum alloy surfaces to subsequently applied overcoatings and varnishes, without adversely affecting the flavor characteristics of beverages and other food products in contact with the treated surfaces.

The composition of the present invention is an aqueous composition comprising a water surface tension reducing agent selected from the group consisting of sulfosuccinate salts and derivatives and mixtures thereof, a surfactant selected from the group consisting of propoxylated and ethoxylated linear alcohols, and an acid, and preferably also includes a bactericide and a defoamant.

The present inventive composition and method are preferably used in conjunction with the processing of drawn and ironed aluminum cans. Specifically, aluminum cans which have been cleaned with an acidic cleaner and rinsed with water are preferably sprayed with the composition of the present invention for about 2–5 seconds at 10°–40° C. and at a pH of about 3–7. The treated cans can then be oven dried and subjected to further processing in the usual course.

DESCRIPTION OF THE PREFERRED EMBODIMENT

Figure 1:
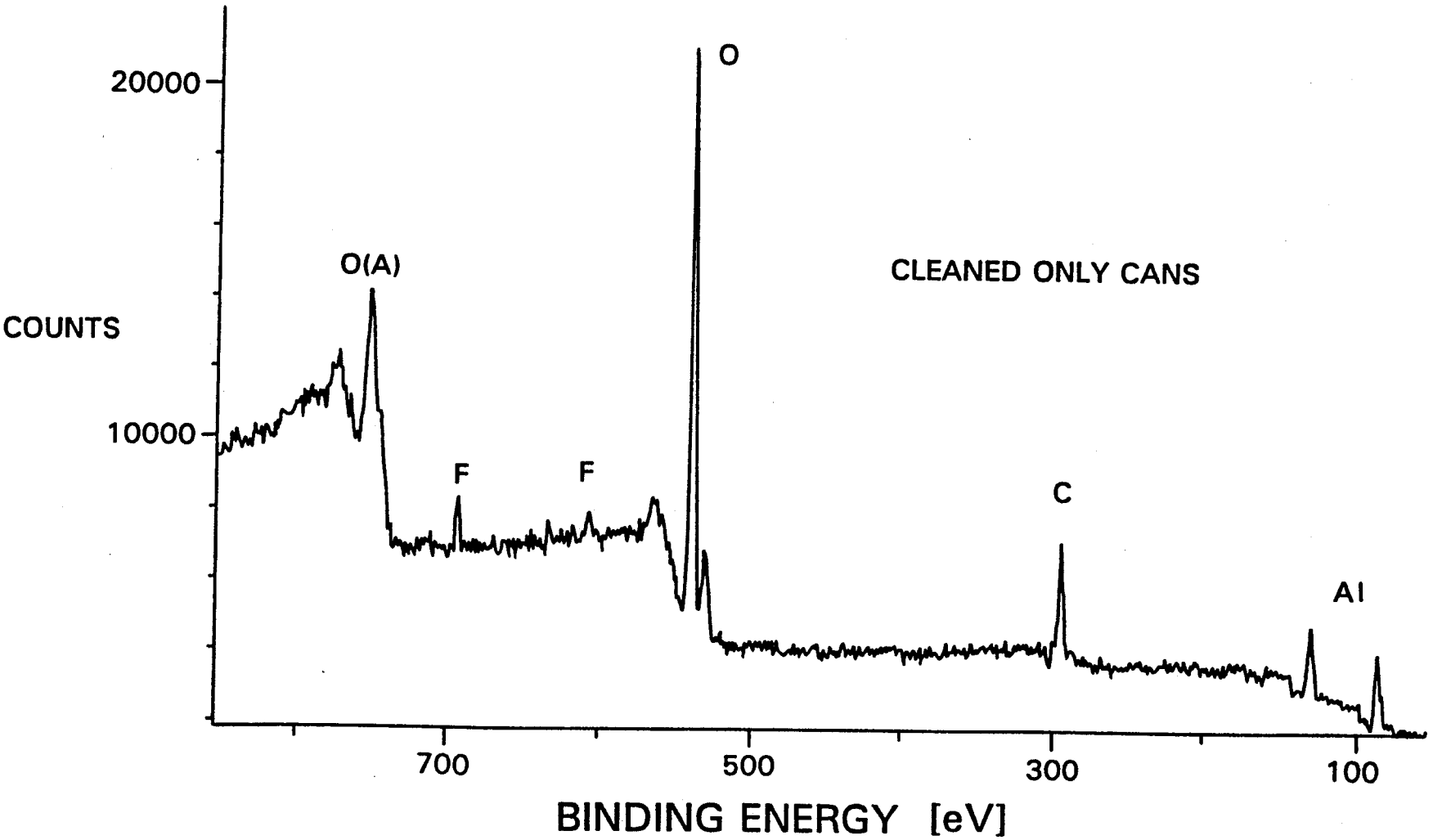
FIG. 1 depicts Electron Spectroscopy for Chemical Analysis (ESCA) results on the surface analysis of an aluminum can cleaned and rinsed but not treated in accordance with the present invention.

The present invention involves a composition and method which provide metal surfaces, particularly aluminum and its alloys, with desirable surface properties. The present inventive composition and method may be used in a wide variety of applications and are particularly useful in the manufacture of aluminum cans, e.g., food and beverage cans. The present invention, therefore, is described in the context of aluminum beverage cans.

Aluminum beverage cans must be cleaned, rinsed, and dried before further processing (e.g., application of overcoatings and finishes) and filling with a beverage. The composition and method of the present invention are used to reduce the surface tension and amount of water remaining on a cleaned and rinsed metal surface in order to reduce the time and/or temperature needed to dry the cleaned and rinsed surface, e.g., aluminum can. The present inventive composition and method also provide the treated metal surface with water-break-free surface characteristics, decreasing the formation of water droplets responsible for the formation of water spots upon drying of the cleaned and rinsed metal surfaces. The adhesion of subsequently applied overcoatings and finishes to the treated metal surface is also optimized by use of the present invention. Furthermore, the thus treated surface does not adversely affect the flavor characteristics of a beverage or other food product in contact with that surface.

The composition of the present invention is an aqueous composition which comprises a water surface tension reducing agent, a surfactant, and an acid, and preferably also includes a bactericide and a defoamant. The composition will typically have an acidic pH, and, in accordance with the method of the present invention, the composition is applied to aluminum and aluminum alloy surfaces during the cleaning and washing of those surfaces. The composition is preferably applied after cleaning and rinsing of the metal surface under any suitable conditions, generally at a temperature between about 10° C. and about 40° C., preferably between about 20° C. and about 25° C., for a suitable period of time, typically ranging from about 2 seconds to about 5 seconds.

The water surface tension reducing agent is selected from the group of sulfosuccinate salts and derivatives and is preferably a dialkylsulfosuccinate salt such as sodium dioctyl sulfosuccinate, sodium dihexyl sulfosuccinate, or sodium ditridecyl sulfosuccinate. Sodium dioctyl sulfosuccinate is most preferred as the water surface tension reducing agent (especially in view of its superior ability not to adversely affect the flavor characteristics of beverages placed in contact with the treated metal surfaces). Commercially available examples of sulfosuccinate-based water surface tension reducing agents include MONAWET MO-70E, MM-80, and MT-70 (Mona Industries, Paterson, N.J.). MONAWET MO-70E, which corresponds to sodium dioctyl sulfosuccinate, is preferred. The concentration of the surface tension reducing agent in the composition may range from about 1 ppm to about 10 ppm, preferably from about 2 ppm to about 5 ppm.

The surfactant is selected from the group of propoxylated and alkoxylated linear alcohols, preferably compounds of formula (I)

$$R-(\underset{\substack{|\\ CH_3}}{OCHCH_2})_x-(OCH_2CH_2)_y-(\underset{\substack{|\\ CH_3}}{OCHCH_2})_z-OH \qquad (I)$$

wherein R represents $C_6$–$C_{10}$ groups, the sum of x and z is 19, and y is 12, and compounds of formula (II)

$$R-(OCHCH_2)_x-(\underset{\substack{|\\ CH_3}}{OCHCH_2})_y-OH \qquad (II)$$

wherein R represents $C_{12}$–$C_{15}$ groups, x is 6 to 15, and y is 5–18. A commercially available surfactant of formula (I) is CHEMAL LFL-17 (Chemax, Inc., Greenville, S.C.), and commercial available surfactants of formula (II) are CHEMAL LFL-19 (x=6–12, y=1-2–18), CHEMAL LFL-28 (x=9–15, y=12–18), CHEMAL LFL-38 (x=9–15, y=9–15), and CHEMAL LFL-47 (x=9–15, y=5–11) (all also available from Chemax, Inc.). A surfactant of formula (I), in particular CHEMAL LFL-17, is most preferred. Other suitable surfactants include MAKON NF-12 (Stepan Chemical Co., Northfield, Ill.) and TRITON DF-12 (Rohm & Haas Co., Philadelphia, Pa.). The surfactants used in conjunction with the present invention will be typically and preferably low-foaming and nonionic surfactants. In particular, a propoxylated and ethoxylated linear alcohol with a cloud point (1% aqueous) below 25° C., such as CHEMAL LFL-17, is a preferred surfactant. The concentration of the surfactant in the composition may range from about 25 ppm to about 250 ppm, preferably from about 50 ppm to about 100 ppm.

An acid is present in the composition in a concentration to maintain an acidic pH in the composition, thereby minimizing or preventing aluminum oxide stain development on the treated metal surfaces. While any suitable acid may be used which does not adversely affect the stability of the composition or cause adverse effects on the treated metal surface, phosphoric acid is preferably used as the acid in the composition in a concentration of from about 0.4 ppm to about 2 ppm, preferably from about 0.8 ppm to about 1.2 ppm. The resulting pH of the composition will generally be about 3 to about 7, preferably between about 2 and about 5.

For ease in handling and storing the composition of the present inventive composition, particularly concentrates thereof prior to dilution to form the final treatment composition, the composition preferably also contains a bactericide. The bactericide may be any suitable bactericide which controls the growth of bacteria but does not adversely affect the composition or treated metal surface. The bactericide is preferably selected from the group of hypochlorites such as chlorine dioxide and trichloroisocyanuric acid. Chlorine dioxide is preferred as the bacericide in the composition, and is commercially available as anthium dioxide (International Dioxide, Inc., Clark, N.J.). The bactericide may be present in the composition in any suitable concentration, typically from about 0.1 ppm to about 2.0 ppm, preferably from about 0.2 ppm to about 0.8 ppm.

The composition of the present invention also preferably includes a defoamant to ensure that the composition does not adversely foam upon application, e.g., by spraying, on the metal surface to be treated. The defoamant may be any suitable defoaming agent which does not adversely affect the composition or treated metal surface such as FOAM BAN MS-455 (Ultra Additives, Paterson, N.J.), PLURONIC L-61 (BASF, Parsippany, N.J.), and TRITON CF-32 (Rohm & Haas Co., Philadelphia, Pa.). Preferred defoamants for use in the composition include defoaming agents known to contain large amounts of high molecular weight glycol mixtures such as FOAM BAN MS-455. Generically, the TRITON defoamant, which can be purchased from Rohm & Haas Co., is an amine polyglycol condensate. Generically, the PLURONIC defoamant, which can be purchased from BASF, is a block copolymer of propylene oxide and ethylene oxide. The concentration of the defoamant in the composition may be of any suitable amount. The defoamant concentration will typically range from about 0.1 ppm to about 0.5 ppm, preferably from about 0.2 ppm to about 0.4 ppm.

EXAMPLES

Aluminum cans were treated with the composition and method of the present invention and then evaluated to determine the effect of the present invention on water surface tension, the conditions required for drying the treated cans, the effect on adhesion by subsequent overcoatings, and any adverse effect on the flavor of beverages placed in the treated cans.

The following Examples are provided to illustrate the invention. These examples, however, should not be construed as limiting the overall scope of the invention.

EXAMPLE 1

Various compositions (Compositions A–E) of the present invention were prepared by adding the following ingredients to deionized water in the indicated concentrations:

TABLE I

| | Compositions (ppm) | | | | |
|---|---|---|---|---|---|
| Components | A | B | C | D | E |
| MONAWET MO-70E[1] | 2.0 | 4.0 | 6.0 | 8.0 | 10.0 |
| CHEMAL LFL-17[2] | 50.0 | 100.0 | 150.0 | 200.0 | 250.0 |
| Phosphoric acid, 75% | 0.4 | 0.8 | 1.2 | 1.6 | 2.0 |
| Anthium dioxide[3] | 0.4 | 0.8 | 1.2 | 1.6 | 2.0 |

TABLE I-continued

| Components | Compositions (ppm) A | B | C | D | E |
|---|---|---|---|---|---|
| FOAM BAN MS-455[4] | 0.1 | 0.2 | 0.3 | 0.4 | 0.5 |

[1]MONAWET MO-70E (commercially available from Mona Industries, Paterson, New Jersey) is a surface tension reducing agent designated as sodium dioctyl sulfosuccinate.
[2]CHEMAL LFL-17 (commercially available from Chemal, Inc., Greenville, South Carolina) is a low foaming, nonionic surfactant designated as an alkoxylated linear alcohol.
[3]Anthium dioxide (commercially available from International Dioxide, Inc., Clark, New Jersey) is a bactericide designated as stabilized chlorine dioxide.
[4]FOAM BAN MS-455 (commercially available from Ultra Additives, Paterson, New Jersey) is a defoamant high in high molecular weight glycol mixtures.

While each of Compositions A–E are encompassed by the present invention, Composition A represents a preferred embodiment of the present inventive composition.

EXAMPLE 2

The following experiment was performed to determine the efficacy of the present invention. Compositions A–E of Example 1 were used to treat typical aluminum cans which were then evaluated in terms of the reduction of water surface tension, the oven temperature required to dry the cans, and the adhesion properties of the treated can surfaces.

Standard drawn and ironed aluminum cans were cleaned with the commercially available acidic cleaner CLENE 101 (Coral International, Inc., Waukegan, Ill.) using a spray washer. After cleaning, the cans were rinsed with cold tap water, followed by deionized water. The cans were then subjected to Compositions A–E of Example 1 at about 25° C. for about 2–5 seconds (Treated Cans A–E). For comparison, some cans were cleaned and rinsed as described above but were not treated with the composition of the present invention (Control Cans).

The present inventive compositions and the treated and control aluminum cans were evaluated by measuring the water surface tension directly (in dynes/cm) and indirectly (number of drops/ml obtained with a 10 ml Nalgene Burotte #3650-0010), determining the oven temperature (°C.) required to dry the cans in about 2 minutes, and performing an adhesion test as described below on the cans.

The tape adhesion test was performed to measure the adhesion between the can surface and an organic finish or overcoating. Miller white ink from Acme was applied, using a rubber brayer, to the can surface, and then water-borne, wet-ink varnish, designated as 3625X from PPG Company, was roll-coated on the can surface with a #10 draw-down bar to achieve a coating thickness of 2.5 mg/in$^2$. The coated surface was cured in a forced-air oven for 90 seconds at about 177° C. The finished (i.e., painted) surface, after being cured, was immersed in boiling tap water for 15 minutes, rinsed in tap water, and dried. The treated surface was then cross-hatched, and Scotch brand transparent tape #610 (3M, St. Paul, Minn.) was applied to the cross-hatched area. The amount of paint removed by the tape (i.e., which did not adhere to the can) was observed, and the results were rated as follows:

| | |
|---|---|
| 10 | Excellent adhesion of coating |
| 8–9 | Very slight removal of coating |
| 0 | Complete removal of coating |

The results of the evaluation of Treated Cans A–E and the Control Cans is set forth below.

TABLE II

| Composition Treated Cans | Surface Tension (dynes/cm) | Drop Test (drops/ml) | Dry-Off Oven Temperature (°C.) | Tape Adhesion Test (rating) |
|---|---|---|---|---|
| A | 44.0 | 31 | 149 | 10 |
| B | 42.6 | 34 | 149 | 10 |
| C | 39.8 | 35 | 149 | 10 |
| D | 36.8 | 36 | 149 | 10 |
| E | 33.6 | 37 | 149 | 10 |
| Control | 72.6 | 21 | 191 | 10 |

The results of this Example indicate that the present invention reduces the water surface tension and the oven temperature required to dry aluminum cans, without adversely affecting the adhesion characteristics of the aluminum cans.

EXAMPLE 3

The present invention was tested at a commercial aluminum can plant experiencing difficulty drying cans in the dry-off oven. The difficulty experienced in drying cans in a dry-off oven is commonly known as a "wet can" problem and typically involves water droplets being retained on the edges of the cans. As a result, overcoatings and finishes will not properly adhere to the wet surfaces when the cans are subjected to high-speed printing. In an attempt to combat the problem, the plant increased the temperature of the dry-off oven to about 245° C. This is an excessively high temperature, at which cans may anneal and be disformed. Annealed cans pose problems during subsequent forming operations when spin necking and flanging occur.

The present invention was experimentally used at the plant in an attempt to solve the wet can problem and reduce the dry-off oven temperature for economical reasons and to avoid potential can deformation problems.

An experimental treatment composition was prepared in accordance with the present invention with the following component concentrations in deionized water:

| Components | ppm |
|---|---|
| MONAWET MO-70E | 2.0 |
| CHEMAL LFL-17 | 50.0 |
| Phosphoric acid, 75% | 0.4 |
| Anthium dioxide | 0.4 |
| FOAM BAN MS-455 | 0.1 |

During the experiment, the can washer process sequence was as follows:

1. Pre-clean, using Coral CLENE 101 acid cleaner.
2. Clean using Coral CLENE 101 acid cleaner.
3. Tap water rinse.
4. Nonchrome treatment or secondary cleaner.
5. Tap water rinse.
6. Deionized water rinse.
7. Treatment with the present invention.
8. Dry-off in hot-air oven.

Treatment of the cans with the experimental treatment composition of the present invention after deionized water rinsing but prior to drying in the dry-off oven reduced the amount of surface water retained on the cans. Consequently, the plant was able to reduce the temperature of the dry-off oven by as much as about 55°

C., and the cans were successfully dried at a temperature of about 190°-195° C. Moreover, in flavor tests using a panel of testing experts as commonly used in the beverage industry to evaluate new chemical treatments of beverage containers, the present inventive composition and method were found not to impart any adverse flavor characteristics to beverages in contact with the treated cans.

EXAMPLE 4

Surface analyses of several different substrates were conducted by ESCA to determine the distribution and concentration of certain components on treated and untreated aluminum can surface. The following samples were prepared and subjected to ESCA surface analysis:

SAMPLE 1: Cleaned only aluminum cans

SAMPLE 2: Aluminum cans cleaned and conversion coated with CORCOAT NC-900 (Coral International, Inc., Waukegan, Ill.)

SAMPLE 3: Aluminum cans cleaned and conversion coated with CORCOAT NC-900 (Coral International, Inc., Waukegan, Ill.) and then treated with Composition A of Example 1

SAMPLE 4: Aluminum cans cleaned and then treated with Composition A of Example 1

Figure 2:
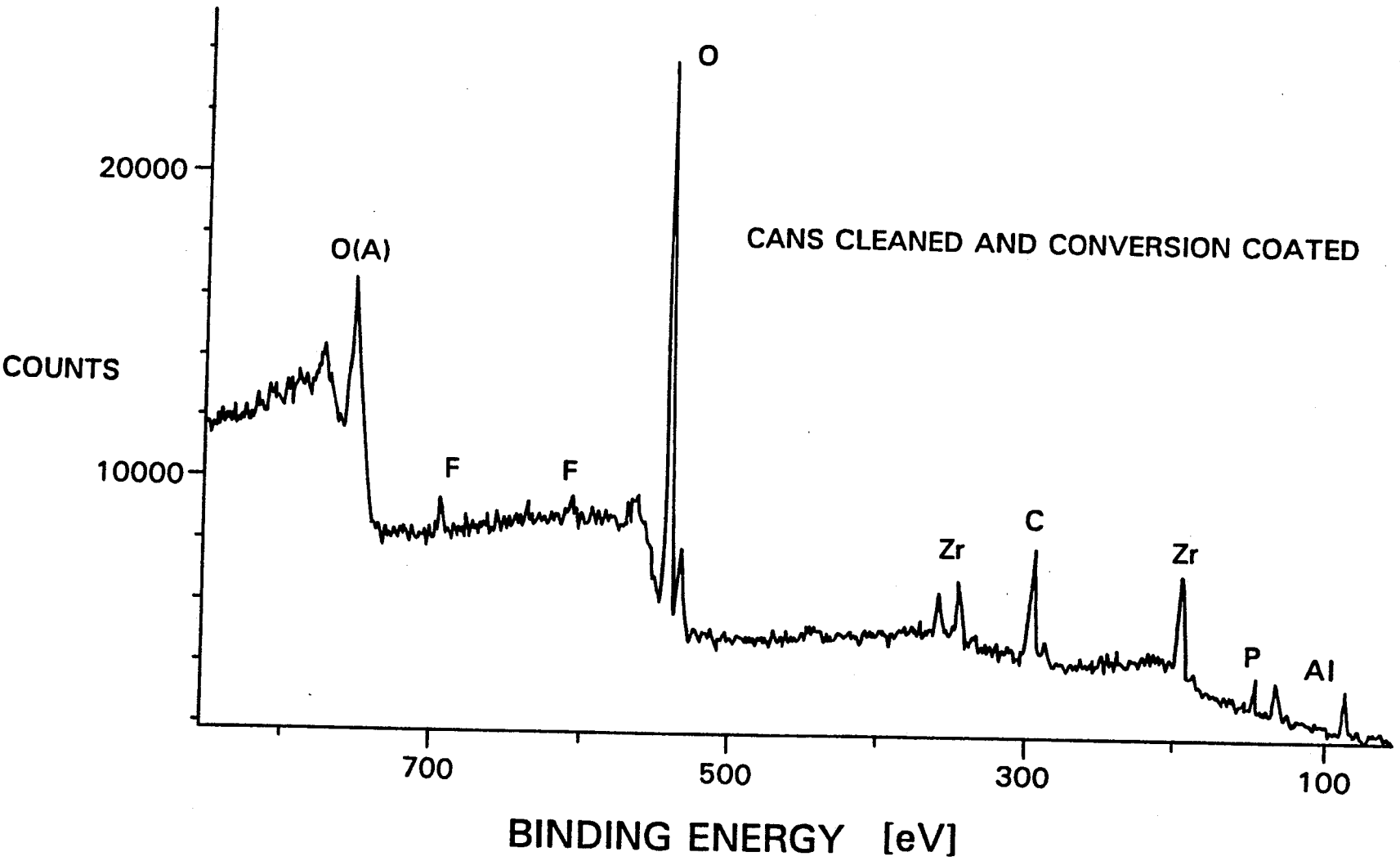
FIG. 2 depicts ESCA results on the surface analysis of an aluminum can cleaned, rinsed, and conversion coated but not treated in accordance with the present invention.
Figure 3:
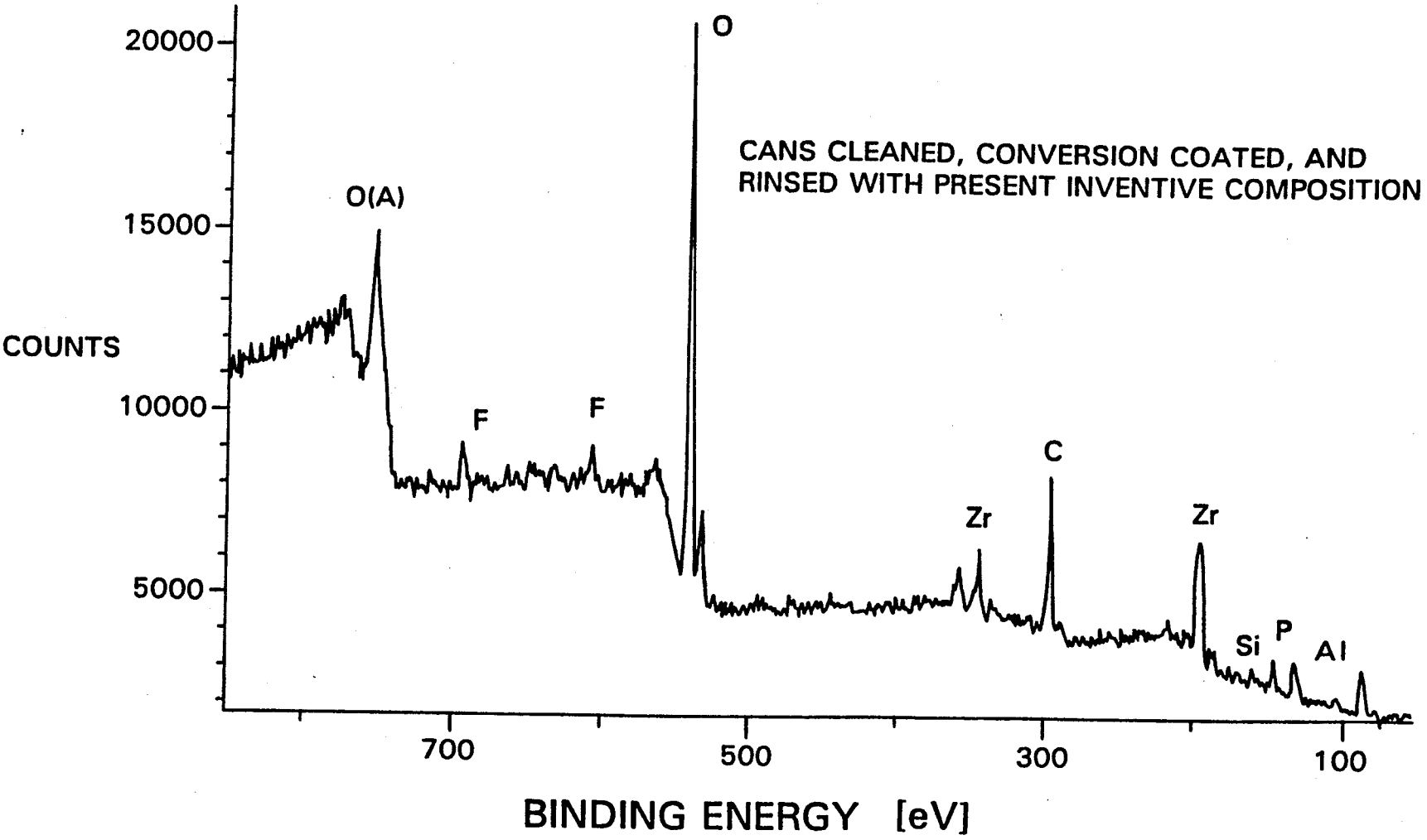
FIG. 3 depicts ESCA results on the surface analysis of an aluminum can cleaned, rinsed, conversion coated, and treated in accordance with the present invention.
Figure 4:
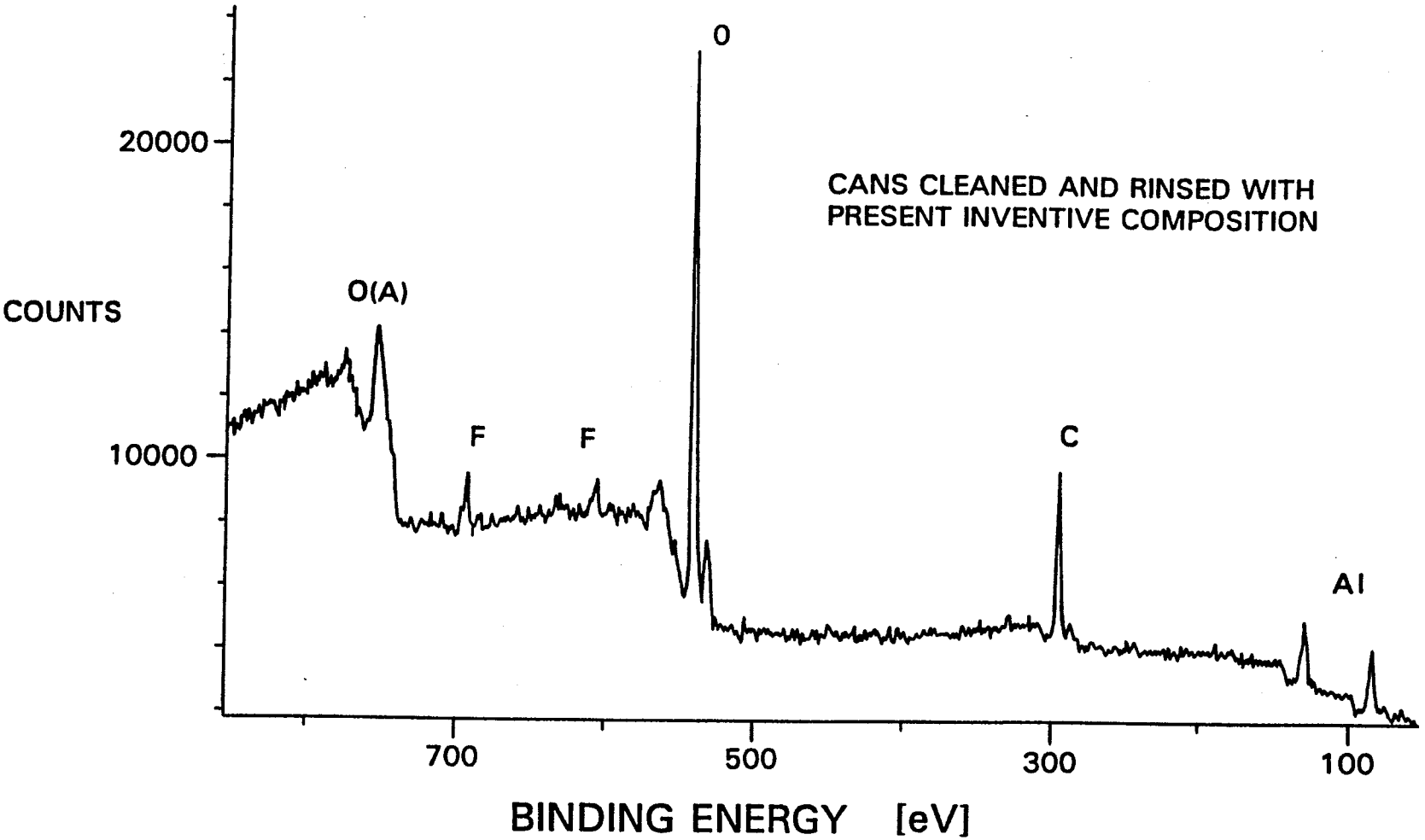
FIG. 4 depicts ESCA results on the surface analysis of an aluminum can cleaned, rinsed, and treated in accordance with the present invention.

The ESCA surface analyses of Samples 1-4 are shown in FIGS. 1-4, respectively. The quantity of various elements (in atomic percent), particularly of carbon and oxygen, on the can sample surfaces were determined from the ESCA spectra of FIGS. 1-4 and are set forth below in Table III.

TABLE III

| | Aluminum (Al) | Oxide (O) | Carbon (C) | Fluoride (F) | Zirconium (Zr) | Phosphorous (P) | Ratio Carbon/Oxide |
|---|---|---|---|---|---|---|---|
| Sample 1: | 23.2 | 64.0 | 7.4 | 5.3 | — | — | 0.11 |
| Sample 2: | 12.5 | 63.3 | 7.1 | 3.2 | 6.4 | 7.4 | 0.11 |
| Sample 3: | 13.2 | 61.8 | 9.2 | 4.3 | 6.4 | 5.1 | 0.15 |
| Sample 4: | 19.1 | 64.9 | 10.8 | 5.2 | — | — | 0.17 |

The data obtained from the ESCA spectra indicated that the organic carbon to oxygen (oxide) ratio on the aluminum surfaces increased when the aluminum cans were treated in accordance with the present invention, thereby evidencing the chemical deposition of the present inventive composition on the treated aluminum surface.

While this invention has been described with an emphasis upon a preferred embodiment, it will be obvious to those of ordinary skill in the art that variations in the preferred composition and method may be used and that it is intended that the invention may be practiced otherwise than as specifically described herein. Accordingly, this invention includes all modifications encompassed within the spirit and scope of the following claims.

What is claimed is:

1. An aqueous composition for treating aluminum and aluminum alloy surfaces comprising from about 1 ppm to about 10 ppm of a water surface tension reducing agent which is a sulfosuccinate salt, from about 25 ppm to about 250 ppm of a surfactant which is a propoxylated and ethoxylated linear alcohol and from about 0.4 ppm to about 2.0 ppm of an acid such that the pH of the composition is from about 3 to about 7.

2. The aqueous composition of claim 1, wherein the sulfosuccinate salt is a dialkylsulfosuccinate salt.

3. The aqueous composition of claim 2, wherein the sulfosuccinate salt is selected from the group consisting of soium dioctyl sulfosuccinate, sodium dihexyl sulfosuccinate, sodium ditridecyl sulfosuccinate, and mixtures thereof.

4. The aqueous composition of claim 3, wherein the sulfosuccinate salt is sodium dioctyl sulfosuccinate.

5. The aqueous composition of claim 1, wherein said surfactant has formula (I)

$$R-(O\underset{\underset{CH_3}{|}}{C}HCH_2)_x-(OCH_2CH_2)_y-(O\underset{\underset{CH_3}{|}}{C}HCH_2)_z-OH \quad (I)$$

wherein R represents $C_6$-$C_{10}$ group, the sum of x and z is 19, and y is 12, or formula (II)

$$R-(OCHCH_2)_x-(O\underset{\underset{CH_3}{|}}{C}HCH_2)_y-OH \quad (II)$$

wherein R represents $C_{12}$-$C_{15}$ group, x is 6 to 15, and y is 5-18, and mixtures of compounds I and II.

6. The aqueous composition of claim 1, wherein said acid is phosphoric acid.

7. The aqueous composition of claim 1, wherein said composition further contains a bactericide.

8. The aqueous composition of claim 7, wherein said bactericide is selected from the group consisting of chlorine dioxide, trichloroisocyanuric acid, and mixtures thereof.

9. The aqueous composition of claim 8, wherein the bactericide is chlorine dioxide.

10. The aqueous composition of claim 7, wherein said composition further contains a defoamant.

11. The aqueous, acidic composition according to claim 10, wherein the defoamant comprises a glycol mixture.

12. The aqueous composition of claim 1, wherein the sulfosuccinate salt is present in a concentration from about 2 ppm to about 5 ppm, said surfactant is present in a concentration from about 50 ppm to about 100 ppm, and said acid is present in a concentration from about 0.8 ppm to about 1.2 ppm such that the pH of the composition is between about 4 and about 6.

13. An aqueous composition for treating aluminum and aluminum alloy surfaces comprising about 1-10 ppm sodium dioctyl sulfosuccinate, about 25-250 ppm compound of the formula $$R-(O\underset{\underset{CH_3}{|}}{C}HCH_2)_x-(OCH_2CH_2)_y-(O\underset{\underset{CH_3}{|}}{C}HCH_2)_z-OH$$

wherein R represents $C_6$-$C_{10}$ group, the sum of x and z is 19, and y is 12, and about 0.4-2.0 ppm phosphoric acid.

14. The aqueous composition of claim 13, wherein said composition further contains about 0.1–2.0 ppm chlorine dioxide and about 0.1–0.5 ppm defoamant.

15. A method for treating aluminum and aluminum alloy surfaces comprising applying, to an aluminum or aluminum alloy surface, an aqueous composition comprising a water surface tension reducing agent which is a sulfosuccinate salt, a surfactant which is a propoxylated and ethoxylated linear alcohol and an acid.

16. The method of claim 15, wherein the sulfosuccinate salt is selected from the group consisting of sodium dioctyl sulfosuccinate, sodium dihexyl sulfosuccinate, sodium ditridecyl sulfosuccinate, and mixtures thereof, said surfactant is selected from the group consisting of compounds of formula (I)

$$R-(O\underset{\underset{CH_3}{|}}{C}HCH_2)_x-(OCH_2CH_2)_y-(O\underset{\underset{CH_3}{|}}{C}HCH_2)_z-OH \quad (I)$$

wherein R represents $C_6$–$C_{10}$ group, the sum of x and z is 19, and y is 12, compounds of formula (II)

$$R-(OCHCH_2)_x-(O\underset{\underset{CH_3}{|}}{C}HCH_2)_y-OH \quad (II)$$

wherein R represents $C_{12}$–$C_{15}$ group, x is 6 to 15, and y is 5–18, and mixtures thereof, and said acid is phosphoric acid.

17. The method of claim 16, wherein the sulfosuccinate salt is sodium dioctyl sulfosuccinate and said surfactant has the formula $$R-(O\underset{\underset{CH_3}{|}}{C}HCH_2)_x-(OCH_2CH_2)_y-(O\underset{\underset{CH_3}{|}}{C}HCH_2)_z-OH$$

wherein R represents $C_6$–$C_{10}$ group, the sum of x and z is 19, and y is 12.

18. The method of claim 15, wherein said composition further comprises a bactericide and a defoamant.

19. The method of claim 18, wherein said bactericide is selected from the group consisting of chlorine dioxide, trichloroisocyanuric acid, and mixtures thereof.

20. The method of claim 17, wherein the sulfosuccinate salt is present in a concentration from about 1 ppm to about 10 ppm, said surfactant is present in a concentration from about 25 ppm to about 250 ppm, and said acid is present in a concentration from about 0.4 ppm to about 2.0 ppm such that the pH of the composition is between about 3 and about 7.

21. The method according to claim 20, wherein said composition is applied to said aluminum or aluminum alloy surface at a temperature between about 10° C. and about 40° C.

22. The method according to claim 21, wherein said composition is applied to said aluminum or aluminum alloy surface at a temperature between about 20° C. and about 25° C.

23. The method according to claim 20, wherein said composition is applied to said aluminum or aluminum alloy surface for about 2 seconds to about 5 seconds.

24. The method according to claim 20, wherein said composition is applied to said aluminum or aluminum alloy surface after being cleaned and rinsed with deionized water.

25. The method of claim 15, wherein the sulfosuccinate is present in a concentration from about 1 ppm to about 10 ppm, said surfactant is present in a concentration from about 25 to about 250 ppm, and said acid is present in a concentration from about 0.4 ppm to about 2.0 ppm such that the pH of the composition is between about 3 and about 7.

26. The method according to claim 25, wherein said composition is applied to said aluminum or aluminum alloy surface at a temperature between about 10° C. and about 40° C.

27. The method according to claim 26, wherein said composition is applied to said aluminum or aluminum alloy surface at a temperature between about 20° C. and about 25° C.

28. The method according to claim 27, wherein said composition is applied to said aluminum or aluminum alloy surface for about 2 seconds to about 5 seconds.

29. The method according to claim 28, wherein said composition is applied to said aluminum or aluminum alloy surface after being cleaned and rinsed with deionized water.

* * * * *